US007510746B2

(12) United States Patent
Loeffler et al.

(10) Patent No.: US 7,510,746 B2
(45) Date of Patent: Mar. 31, 2009

(54) PROCESS FOR PRODUCTION OF MULTILAYER COATING INCLUDING CURING CLEAR-COAT COMPOSITION WITH HIGH-ENERGY RADIATION

(75) Inventors: Helmut Loeffler, Hennef (DE); Nadja Doerigmann, Wuppertal (DE); Juergen Peter Stropp, Wuppertal (DE)

(73) Assignee: E.I. du Pont de Nemours and Company, Wilmington, DE (US)

( * ) Notice: Subject to any disclaimer, the term of this patent is extended or adjusted under 35 U.S.C. 154(b) by 823 days.

(21) Appl. No.: 10/861,950

(22) Filed: Jun. 4, 2004

(65) Prior Publication Data

US 2005/0271824 A1 Dec. 8, 2005

(51) Int. Cl.
*B05D 3/06* (2006.01)
*B05D 7/16* (2006.01)

(52) U.S. Cl. ..... 427/496; 427/492; 427/500; 427/551; 427/407.1; 427/409; 427/140

(58) Field of Classification Search ..... None
See application file for complete search history.

(56) References Cited

U.S. PATENT DOCUMENTS

| | | | | |
|---|---|---|---|---|
| 5,254,395 | A | 10/1993 | Hodnett, III | |
| 5,486,384 | A * | 1/1996 | Bastian et al. | 427/493 |
| 6,528,126 | B1 * | 3/2003 | Kimpel et al. | 427/493 |
| 6,660,374 | B2 * | 12/2003 | Smetana et al. | 428/327 |
| 7,399,793 | B2 * | 7/2008 | Braun et al. | 522/120 |

FOREIGN PATENT DOCUMENTS

| | | | |
|---|---|---|---|
| DE | 199 20 801 | | 11/2000 |
| EP | 568 967 | | 10/1993 |
| EP | 0983801 | A2 | 3/2000 |
| WO | WO 00/67919 | A1 * | 11/2000 |

OTHER PUBLICATIONS

English-language machine translation of WO 00/67919 A1 from EPO.*

English-language machine translation of WO 00/67919 A1 form EPO, generated Jan. 9, 2008.*

The PCT International Search Report and the Written Opinion of the International Searching Authority, No. PCT/US2005/019405, mailed Oct. 27, 2005.

* cited by examiner

*Primary Examiner*—William Phillip Fletcher, III
(74) *Attorney, Agent, or Firm*—Sudhir G. Deshrmukh

(57) ABSTRACT

The invention is directed to a process for the production of a multi-layer coating comprising the following steps:

A) applying a base coat layer of a pigmented color-imparting and/or special effect-imparting base coat composition onto a substrate precoated with at least one coating layer, B) applying a coating layer of a coating composition curable by means of high-energy radiation, wherein the coating composition comprises at least one oligomeric and/or polymeric binder curable by means of high-energy radiation and does contain low molecular weight reactive diluents curable by means of high-energy radiation, C) curing the coating layer applied in step B) by irradiation with high-energy radiation, D) applying a clear coat layer of a transparent clear coat composition curable by means of high-energy radiation which comprises low molecular weight reactive diluents curable by means of high-energy radiation and E) curing the clear coat layer applied in step D) by irradiation with high-energy radiation.

14 Claims, No Drawings

PROCESS FOR PRODUCTION OF MULTILAYER COATING INCLUDING CURING CLEAR-COAT COMPOSITION WITH HIGH-ENERGY RADIATION

BACKGROUND OF THE INVENTION

1. Field of Invention

The invention relates to a process for the production of a multi-layer coating based on a base coat layer and a UV curable clear coat layer and in particular is used for coating vehicles and for the repair of vehicle coatings.

2. Description of Related Art

In vehicle repair coating, apart from coating entire vehicle bodies and large body parts, touching up relatively small blemished areas by means of spot repair is an efficient and economic alternative. To improve the efficiency of the repair coating of small blemished areas and bodywork parts, endeavors are being made to reduce conventional drying or curing times.

It is known that the various coating layers of a multi-layer structure, such as, for example, the filler, base coat, clear coat and/or one-layer top coat layer, may be cured extremely rapidly by means of UV (ultraviolet light) radiation if an appropriate binder is used. Even by using just one UV curable coating layer in the multi-layer structure, for example, a UV curable clear coat layer makes a considerable contribution to reducing drying and curing times and thus reduces the overall processing time. Solvent-containing or solvent-free UV curable clear coats are generally based on polymeric and/or oligomeric binders in combination with low molecular weight UV curable reactive diluents having appropriate functional groups for UV curing. However, if such clear coats containing reactive diluents are applied onto solvent-based or water-based base coat layers and cured by means of UV radiation, they often result in severe solvent attack of the underlying base coat layer and sometimes cause considerable, unacceptable changes to the colour of the base coat layer. In extreme cases, the base coat/clear coat structure may even be completely destabilised, which may result in the entire coating structure becoming detached from the substrate.

EP 568967 describes a process, in particular for use in vehicle original coating, in which a thermally curable clear coat layer is first applied onto a pigmented base coat layer and then the base coat and clear coat layer are stoved (baked) at temperatures of up to 150° C. A radiation-curable clear coat layer is then applied and cured.

DE 199 20 801 describes a process in which a thermally curable and radiation-curable clear coat is first applied onto a base coat layer and partially cured. Then a second radiation curable clear coat containing nanoparticles is applied and both clear coats are cured thermally and by irradiation with UV radiation.

The problems which occur in the multi-layer structure when reactive diluents are used in UV curable clear coats are not addressed in these references.

In order to permit the use of a multi-layer coating structure comprising a pigmented base coat and a UV curable clear coat containing reactive diluents, in particular also for vehicle repair coating, it is necessary to prevent or at least greatly reduce any colour change and destabilisation of the base coat layer or of the base coat/clear coat structure. There is accordingly a requirement for a suitable process which makes it possible in the above multi-layer structure to use UV curable clear coats based on low molecular weight reactive diluents without encountering the above disadvantages of the prior art.

SUMMARY OF THE INVENTION

The present invention relates to a process for the production of a multi-layer coating, in particular a multi-layer vehicle or vehicle repair coating, comprising the following steps:

A) applying a base coat layer of a pigmented colour-imparting and/or special effect-imparting base coat composition onto a substrate precoated with at least one coating layer, B) applying a coating layer of a coating composition curable by means of high-energy radiation onto the base coat layer, wherein the coating composition comprises at least on oligomeric and/or polymeric binder curable by means of high-energy radiation and does not contain low molecular weight reactive diluents curable by means of high-energy radiation, preferably of an average molar mass of <500 g/mol, C) curing the coating layer applied in step B) by irradiation with high-energy radiation, D) applying a clear coat layer of a transparent clear coat composition curable by means of high-energy radiation onto the cured coating layer which comprises a) at least one oligomeric and/or polymeric binder curable by means of high-energy radiation, b) at least one reactive diluent curable by means of high-energy radiation, preferably having an average molar mass of <500 g/mol, c) photoinitiators and optionally d) conventional coating additives, organic solvents and/or water, and E) curing the clear coat layer applied in step D) by irradiation with high-energy radiation.

Using the process according to the invention, it is possible to use radiation-curable clear coats containing reactive diluents in a multi-layer structure with pigmented base coats. The advantage of using radiation-curable reactive diluents in radiation-curable clear coats, or in radiation-curable coatings in general, is that the proportion of volatile organic solvents may be reduced and by using reactive diluents, crosslinking density and technical properties of the coating, such as body, flow and gloss may more readily be adjusted.

DETAILED DESCRIPTION OF THE EMBODIMENTS

The features and advantages of the present invention will be more readily understood, by those of ordinary skill in the art, from reading the following detailed description. It is to be appreciated those certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both preceded by the word "about." In this manner, slight variations above and below the stated ranges can be used to achieve substantially the same results as values within the ranges. Also, the disclosure of these ranges is intended as a continuous range including every value between the minimum and maximum values.

All patents, patent applications and publications referred to herein are incorporated by reference in their entirety.

The individual steps of the process according to the invention will be described in detail below.

In step A) of the process according to the invention, a base coat layer of a pigmented colour-imparting and/or special effect-imparting base coat composition is applied onto a substrate precoated with at least one coating layer. Suitable substrates which may be considered in this connection are metal and plastics substrates, in particular the substrates known in the automotive industry, such as, for example, iron, zinc, aluminium, magnesium or the alloys thereof, together with plastics, such as polyurethanes, polycarbonates or polyolefins. While the substrates do indeed preferably comprise vehicles or vehicle parts, it is in principle also possible to coat any desired other substrates.

The substrates, preferably vehicles, are already precoated prior to application of the base coat. The prior coating generally comprises a coating of a filler coating composition and/or a primer coating composition, as is conventionally used in vehicle coating. The filler coating compositions may also perform the function of a filler-primer or priming filler. The fillers contain the conventional constituents, such as, for example, binders, additives, extenders, organic solvents and/or water. For example, the fillers may contain binder systems based on physically drying binders, such as physically drying polyurethane and/or polyacrylate resins, and/or based on chemically crosslinking binder systems, such as epoxy resins and polyamine curing agents or hydroxy-functional resins and polyisocyanate crosslinking agents. The fillers used may be solvent-based or water-based.

In addition to or instead of the filler coating, the prior coating may comprise, in the former case preferably beneath the filler layer, coatings of electro-dipcoated primers, primers or further coating compositions. The coating compositions used here may be solvent-based or water-based.

The base coat to be applied in step A) preferably comprises a colour-imparting and/or special effect-imparting base coat such as is conventionally used in vehicle coating. It may comprise conventional solvent-based or water-based base coats. The base coats generally contain binders, colour-imparting and/or special effect-imparting pigments, additives, organic solvents and/or water.

Usable binders are, for example, those based on water-dilutable or solvent-dilutable polyurethane, acrylated polyurethane, polyacrylate, polyester, acrylated polyester and/or alkyd resins. The binder systems may be physically drying and/or chemically crosslinking by means of addition polymerisation, polycondensation and/or polyaddition reactions. Chemically crosslinkable binder systems contain appropriate crosslinkable functional groups. Suitable functional groups are, for example, hydroxyl groups, isocyanate groups, acetoacetyl groups, unsaturated groups, for example, (meth) acryloyl groups, epoxy groups and amino groups. Crosslinking agents with appropriate, complementarily reactive functional groups may be present for the purpose of crosslinking. Additional resins, such as melamine resins or cellulose esters may also be present.

The colour-imparting and/or special effect-imparting base coat furthermore contains colouring pigments and/or special effect pigments. Suitable colouring pigments are any conventional coating pigments of an organic or inorganic nature. Examples of inorganic or organic colouring pigments are titanium dioxide, micronised titanium dioxide, iron oxide pigments, carbon black, azo pigments, phthalocyanine pigments, quinacridone or perylene or pyrrolopyrrole pigments. Soluble dyes and/or transparent pigments may optionally also be present. Examples of special effect pigments are metal pigments, for example made from aluminium or copper, interference pigments, such as, for example, metal oxide coated metal pigments, for example aluminium coated with titanium dioxide, iron oxide or mixed oxide, coated mica, such as, for example, mica coated with titanium dioxide and/or coated with additional metal oxides, for example, $Fe_2O_3$ and/or $Cr_2O_3$, iron oxide in flake form and graphite pigments.

Paste resins, for example based on polyurethane or acrylic resin, may also be used in the base coat for grinding the pigments.

The colour-imparting- and/or special effect-imparting base coats may also contain conventional coating additives. Examples of these are levelling agents, rheological agents, such as highly disperse silica or polymeric urea compounds, thickeners, such as polyacrylate thickeners containing carboxyl groups or associative thickeners, for example, based on polyurethanes, microgels, defoamers, wetting agents, anticratering agents, adhesion promoters and curing accelerators. The additives are used in conventional amounts known to the person skilled in the art.

The colour-imparting and/or special effect-imparting base coats furthermore contain, in the case of solvent-based base coats, organic solvents and, in the case of water-based base coats, water and optionally, proportions of organic, preferably water-miscible solvents. The organic solvents comprise conventional coating solvents.

The base coats applied in step A) may be dried or cured after application. This may proceed, for example, at room temperature or be forced at higher temperatures, for example of up to 80° C., preferably at 40 to 60° C. The coatings may, however, also be dried or cured at higher temperatures of, for example, 80-150° C. Preferably, however, the coating composition subsequently applied in step B) is applied wet-on-wet, e.g. after a flash-off phase of 10-20 minutes at room temperature.

The coating composition curable by means of high-energy radiation to be applied in step B) comprises a coating composition containing binders which, on irradiation with high-energy radiation, crosslink by means of cationic and/or free-radical polymerisation. It preferably comprises a transparent clear coat (hereinafter abbreviated to UV clear coat I). In principle, UV clear coat I may contain, in addition to the above-stated binders, additional binders, photoinitiators, conventional coating additives and/or water.

The cationically polymerisable binders comprise conventional binders known to the person skilled in the art, such as, for example, polyfunctional epoxy oligomers which contain two or more epoxy groups per molecule. These comprise, for example, polyalkylene glycol diglycidyl ethers, hydrogenated bisphenol A glycidyl ethers, epoxyurethane resins, glycerol triglycidyl ether, diglycidyl hexahydrophthalate, diglycidyl esters of dimer acids, epoxidised derivatives of (methyl)cyclohexene, such as, for example, 3,4-epoxycyclohexylmethyl (3,4-epoxycyclohexane) carboxylate or epoxidised polybutadiene. The number average molar mass of the polyepoxy compounds is preferably from 500 to 10,000 g/mol.

The free-radically polymerisable binders comprise binders known to the person skilled in the art with free-radically polymerisable olefinic double bonds. These binders comprise prepolymers, such as polymers and/or oligomers, which contain less than one, one or more than one, for example, on average 0.1 to 20, preferably 0.2-10, particularly preferably 0.2-3 free-radically polymerisable olefinic double bonds per molecule. The polymerisable double bonds may, for example, be present in the form of (meth)acryloyl, vinyl, allyl, maleate and/or fumarate groups. The free-radically polymerisable double bonds are particularly preferably present in the form of (meth)acryloyl groups. Both here and below, (meth)acryloyl or (meth)acrylic are intended to mean acryloyl and/or methacryloyl or acrylic and/or methacrylic.

Examples of the above-stated prepolymers are (meth)acryloyl-functional poly(meth)acrylates, polyurethane (meth) acrylates, polyester (meth)acrylates, unsaturated polyesters, polyether (meth)acrylates, silicone (meth)acrylates, epoxy (meth)acrylates, amino (meth)acrylates and melamine (meth) acrylates. The number average molar mass Mn of these compounds may, for example, be from 500 to 10,000 g/mol, preferably from 500 to 5000 g/mol. The binders may be used individually or as a mixture. (Meth)acryloyl-functional poly (meth)acrylates and/or polyurethane (meth)acrylates are preferably used. Free-radically polymerisable binders are preferably used.

In addition to the binders free-radically and/or cationically polymerisable by means of high-energy radiation, or in addition to the free-radically and/or cationically polymerisable functional groups, the UV clear coats I may additionally contain further binder components or further functional groups which are chemically crosslinkable by an additional curing mechanism. These comprise, for example, functional groups crosslinkable by an addition and/or condensation reaction. The addition and/or condensation reactions of the above-stated kind comprise coatings chemistry crosslinking reactions known to the person skilled in the art, such as, for example, ring-opening addition of an epoxy group onto a carboxyl group with formation of an ester and a hydroxyl group, the addition of a hydroxyl group onto an isocyanate group with formation of a urethane group, the addition of an optionally blocked amino group onto an isocyanate group with formation of a urea group, the reaction of a hydroxyl group with a blocked isocyanate group with formation of a urethane group and elimination of the blocking agent, the reaction of a hydroxyl group with an n-methylol group with elimination of water, the reaction of a hydroxyl group with an n-methylol ether group with elimination of the etherification alcohol, the transesterification reaction of a hydroxyl group with an ester group with elimination of the esterification alcohol, the transurethanisation reaction of a hydroxyl group with a carbamate group with elimination of alcohol, the reaction of a carbamate group with an n-methylol ether group with elimination of the etherification alcohol, the attachment of an amino group onto an epoxy group with ring-opening and formation of a secondary hydroxyl group and the addition reaction of an amino group or an acetoacetyl group onto a group with olefinically unsaturated double bonds, for example, an acryloyl group.

Moisture-curing binder components are also possible, for example compounds with free isocyanate groups, with hydrolysable alkoxysilane groups or with ketimine- or aldimine-blocked amino groups.

The additional functional groups and the free-radically and/or cationically polymerisable functional groups may be present in the same binder and/or in separate binders. The UV clear coats I may advantageously also contain proportions of at least one physically drying binder. For example, up to 30 wt. %, preferably 5-15 wt. % of at least one physically drying binder, relative to the total quantity of the free-radically and/or cationically polymerisable binder (solids content) may be present. The physically drying binders, for example, may be based on polyacrylate, polyurethane, polyester resins and/or cellulose esters, such as, for example, cellulose acetobutyrate. Preferably cellulose esters are used.

An essential feature of the invention is that the UV clear coat I applied in step B) contains no reactive diluents curable by means of high-energy radiation, preferably, of an average molar mass of <500 g/mol. Reactive diluent is the name for reactive thinners or solvents which, according to DIN 55945: 1996-09, are defined as follows: "Diluents which, on film formation, are incorporated by chemical reaction into the binder." The nature and functional groups of the reactive diluents are determined by the binder/coating system in which they are to be used.

The UV clear coats I contain one or more photoinitiators, for example, in quantities of 0.1 to 5 wt. %, preferably of 0.5 to 3 wt. %, relative to the sum of free-radically polymerisable prepolymers and photoinitiators. Examples of photoinitiators for free-radically polymerisable systems are benzoin and derivatives thereof, acetophenone and derivatives thereof, for example, 2,2-diacetoxyacetophenone, benzophenone and derivatives thereof, thioxanthone and derivatives thereof, anthraquinone, 1-benzoylcyclohexanol, organophosphorus compounds, such as, for example, acylphosphine oxides. Examples of photoinitiators for cationically polymerisable systems are onium salts, such as, for example, diazonium salts and sulfonium salts. The photoinitiators may be used individually or in combination.

The UV clear coats I may contain transparent pigments, soluble dyes and/or conventional coating additives. Examples of conventional coating additives include levelling agents, rheological agents, such as highly disperse silica or polymeric urea compounds, thickeners, for example, based on partially crosslinked, carboxy-functional polymers or on polyurethanes, defoamers, wetting agents, anticratering agents, catalysts, antioxidants and light stabilisers based on HALS (hindered amine light stabilizer) products and/or UV absorbers. The additives are used in conventional amounts known to the person skilled in the art.

The UV clear coats I may contain water and/or organic solvents. The latter comprise conventional organic coating solvents known to the person skilled in the art. The UV clear coats I advantageously contain organic solvents to establish the desired application viscosity. The UV clear coats I are applied in ultimate dry film thicknesses of approx. 10-40 μm, preferably by spraying.

Once the UV clear coat I has been applied in step B), the resultant coating is completely cured by irradiation with high-energy radiation. The high-energy radiation used may comprise UV radiation or electron beam radiation, UV radiation being preferred. The source of radiation used for the preferred case of UV radiation comprises UV radiation sources emitting in the wave length range from 180 to 420 nm, in particular from 200 to 400 nm. Examples of such UV radiation sources are optionally doped high, medium and low pressure mercury vapour emitters, gas discharge tubes, such as, for example, low pressure xenon lamps and UV lasers.

Apart from these continuously operating UV radiation sources, however, it is also possible to use discontinuous UV radiation sources. These are preferably so-called high-energy flash devices (UV flash lamps for short). The UV flash lamps may contain a plurality of flash tubes, for example, quartz tubes filled with inert gas such as xenon. The UV flash lamps may have a power of, for example, 500-3000 Ws. UV flash lamps are commercially available, e.g. from Visit, Würtzburg, Germany.

The irradiation time with UV radiation when UV flash lamps are used as the UV radiation source may be, for example, in the range from 1 millisecond to 400 seconds, preferably from 2 to 160 seconds, depending on the number of flash discharges selected. The flashes may be triggered, for example, about every 1-4 seconds. Curing may take place, for example, by means of 1 to 40 successive flash discharges.

If continuous UV radiation sources are used, the irradiation time may be, for example, in the range from a few seconds to about 5 minutes, preferably less than 5 minutes. The distance between the UV radiation sources and the surface to be irradiated may be, for example, 5 to 60 cm.

When the coating is irradiated by means of UV radiation, in particular with UV flash lamps, temperatures may be generated on the coating which are such that, in the event that the coating compositions cure by an additional crosslinking mechanism as well as polymerisation, they give rise to at least partial curing by means of this additional crosslinking mechanism. However, in order to cure the coating composition by means of the additional crosslinking mechanism, the coatings may also be separately exposed to the temperatures required for the additional chemical crosslinking to complete the curing, for example, by exposing to IR radiation.

After complete curing of the layer of the UV clear coat I by irradiation with UV radiation and optionally with thermal energy, a further clear coat curable by means of high-energy radiation (hereinafter denoted UV clear coat II) is applied directly without any intermediate step and without any further intermediate treatment, e.g. without a roughening or sanding step (step D).

UV clear coat II comprises a) at least one oligomeric and/or polymeric binder curable by means of high-energy radiation, b) at least one reactive diluent curable by means of high-energy radiation, preferably of an average molar mass of <500 g/mol, c) photoinitiators and optionally, d) conventional coating additives, organic solvents and/or water, whereby the oligomeric and/or polymeric binder curable by means of high-energy radiation and the reactive diluent curable by means of high-energy radiation are preferably present in a ratio by weight of said oligomeric and/or polymeric binder: said reactive diluent of 1:0.3 to 1:3.

The oligomeric and/or polymeric binders a) may comprise the same UV curable binders as have already been stated above in the description of UV clear coat I.

The reactive diluents b) curable by means of high-energy radiation comprise in principle free-radically or cationically polymerisable low molecular weight compounds, preferably with an average molar mass of <500 g/mol which correspond to the above-stated definition. The reactive diluents may be mono-, di- or polyfunctional. Examples of free-radically polymerisable monounsaturated reactive diluents are: (meth) acrylic acid and the aliphatic or cycloaliphatic esters thereof, such as for example butyl acrylate, (2-ethylhexyl) acrylate, cyclohexyl (meth)acrylate, isobornyl (meth)acrylate, maleic acid and the semi-esters thereof, vinyl acetate, vinyl ethers, substituted vinylureas, styrene, vinyltoluene. Examples of free-radically polymerisable diunsaturated reactive diluents are: di(meth)acrylates, such as alkylene glycol di(meth)acrylates, polyethylene glycol di(meth)acrylate, 1,3-butanediol di(meth)acrylate, vinyl (meth)acrylate, allyl (meth)acrylate, dipropylene glycol di(meth)acrylate, hexanediol di(meth) acrylate and divinylbenzene. Examples of free-radically polymerisable polyunsaturated reactive diluents are: glycerol tri(meth)acrylate, trimethylolpropane tri(meth)acrylate, pentaerythritol tri(meth)acrylate, pentaerythritol tetra(meth) acrylate. Examples of reactive diluents in free-radically curing systems which cure by means of high-energy are also listed, for example, in Römpp Enzyclopedia Coatings and Inks (Georg Thieme publisher, Stuttgart, N.Y., 1998, page 491), divided into standard monomers and special monomers.

Examples of cationically polymerisable reactive diluents are cyclohexene oxide, butene oxide, butanediol diglycidyl ether or hexanediol diglycidyl ether.

The reactive diluents may be used alone or as a mixture.

In order to achieve good results in the coating structure, the UV curable binders a) and the UV curable reactive diluents b) are preferably used in a ratio by weight of UV curable binder: UV curable reactive diluent of 1:0.5 to 1:3, particularly preferably of 1:1 to 1:2. The proportions may here be varied within the above-stated limits as a function of the desired application viscosity and in order to establish technical properties such as gloss, flow, body and crosslinking density.

Apart from the UV curable binders a) and the UV curable reactive diluents b), the UV clear coats II may also contain further chemically crosslinkable and/or physically drying binders as have already been stated above in the description of UV clear coat I. The additional functional groups and the free-radically and/or cationically polymerisable functional groups may here in turn be present in the same binder and/or in separate binders.

The photoinitiators c) and the conventional coating additives and organic solvents (component d) comprise the same compounds have already been listed above in the description of UV clear coat I. In order to increase scratch resistance, nanoparticles, for example based on coated silicon dioxide, and special transparent, coated extenders may be present. Extenders which may be considered here are, for example, micronised aluminium oxide or micronised silicon oxides. These transparent extenders are coated with compounds which contain UV curable groups, for example with acryloyl-functional silanes, and are thus included in the radiation curing of the clear coat. The extenders are available as commercial products, for example under the name AKTISIL®. The nanoparticles and special extenders may, of course, also already be present in UV clear coat I.

The UV clear coats II may be formulated as 100% systems, i.e. based solely on binders a) and reactive diluents b), without addition of water or organic solvents, or as solvent- and/or water-containing systems. They are generally preferably applied by spraying to ultimate dry film thicknesses of approx. 20-80 μm, preferably of 40-80 μm.

Curing by irradiation with high-energy radiation in step E) then proceeds in a similar manner to the method described in step C) and under the conditions stated therein. Additionally, the coating may be exposed to thermal energy, e.g. IR (infra red) radiation.

The process according to the invention makes it possible to use UV clear coats based on UV curable reactive diluents in a multi-layer structure together with colour-imparting and/or special effect-imparting base coats without in so doing having to accept the known disadvantages of the prior art with regard to solvent attack of the base coat and colour changes thereof. The final multi-layer coating shows an excellent inter-layer adhesion between UV clear coat I and UV clear coat II as well as between the multi-layer UV clear coat and the base coat. In comparison with the use of conventional solvent-based or water-based clear coats, overall processing times may be greatly shortened by the use according to the invention of the UV curable multi-layer clear coat structure thanks to the short flash-off times and extremely short UV curing times. A polishable surface with perfect optical appearance is obtained immediately after radiation curing of UV clear coat II. The process according to the invention is in particular usable in vehicle coating and vehicle repair coating, especially in spot repair coating.

The present invention is further defined in the following Examples. It should be understood that these Examples are given by way of illustration only. From the above discussion and these Examples, one skilled in the art can ascertain the essential characteristics of this invention, and without departing from the spirit and scope thereof, can make various changes and modifications of the invention to adapt it to various uses and conditions. As a result, the present invention is not limited by the illustrative examples set forth herein below, but rather is defined by the claims contained herein below.

EXAMPLES

Example 1

Production of UV Clear Coat I

The following components were mixed together and homogenised for a few minutes by means of a high-speed stirrer:

- 23.9 g of a conventional commercial aliphatic polyurethane acrylate (Viaktin VTE 6160; 100%; UCB)
- 3.0 g of a conventional commercial photoinitiator based on α-hydroxyketone derivatives (Darocur® 1173; CIBA)
- 0.7 g of a conventional commercial light stabiliser based on HALS derivatives (Tinuvin®292; CIBA)
- 0.7 g of a conventional commercial UV absorber based on benzotriazole derivatives (Tinuvin® 400; CIBA)
- 0.1 g of a conventional commercial levelling agent (Byk® 331; BYK) 71.6 g of ethyl acetate Production of UV Clear Coat II The following components were mixed together and homogenised for a few minutes by means of a high-speed stirrer:

- 45.3 g of a conventional commercial aliphatic polyurethane acrylate (Roskydal® UA VP LS 2308, 80% in hexanediol diacrylate; Bayer)
- 50.2 g of a conventional commercial UV crosslinking reactive diluent (hexanediol diacrylate)
- 3.0 g of a conventional commercial photoinitiator based on α-hydroxyketone derivatives (Darocur® 1173; CIBA)
- 0.7 g of a conventional commercial light stabiliser based on HALS derivatives (Tinuvin® 292; CIBA)
- 0.7 g of a conventional commercial UV absorber based on benzotriazole derivatives (Tinuvin® 400; CIBA)
- 0.1 g of a conventional commercial levelling agent (Byk® 331)

Production of the Multi-Layer Structure

A conventional commercial solvent-based two-pack polyurethane filler (Standox two-pack HS system filler with Standox curing agent HS 20-30 in a 4:1 ratio by volume) was applied to an ultimate dry film thickness of approx. 80 μm onto a metal sheet coated by cathodic electro-dipcoating and, after flashing-off for 10 minutes (at room temperature), was cured for 30 minutes at 60° C.

The filler layer was sanded and then a conventional commercial solvent-based silver metallic base coat (Standox base coat Mix 595) was applied to an ultimate dry film thickness of 15 μm.

After flashing-off for 20 minutes at room temperature, the UV clear coat I produced as described above was applied to an ultimate dry film thickness of approx. 20 μm. After flashing-off for 10 minutes at room temperature, the clear coat layer was completely cured by irradiation with a UV flash lamp (1500 Ws; UV Flash from VISIT). UV irradiation was performed in 20 flashes, the flashes being triggered at approx. 1 second intervals. The object temperature was approx. 60 to 80° C. during this operation.

Then, without any further intermediate treatment, the UV clear coat II produced as described above was applied to an ultimate dry film thickness of approx. 40 μm onto the clear coat layer radiation-cured in this manner. Clear coat layer II was cured without an intermediate flash-off phase by irradiation by means of 20 flashes with a UV flash lamp (1500 Ws; from VISIT), the flashes being triggered at approx. 1 second intervals. The object temperature was approx. 60 to 80° C. during this operation.

Immediately on completion of the radiation curing of UV clear coat II, a ready-to-use vehicle repair coating was obtained which could then be polished with conventional commercial products.

Example 2

Comparative Example

A method similar to that of Example 1 was used, except that, after application of the solvent-based base coat and the flash-off phase, the UV clear coat II produced as described above was directly applied to an ultimate dry film thickness of approx. 40 μm. The UV isolation coating layer based on UV clear coat I was not applied. The radiation curing parameters with the UV flash lamp were the same as those in Example 1.

Example 3

Comparative Example

A method similar to that of Example 1 was used, except that, after application of the solvent-based base coat and the flash-off phase, a conventional two-pack polyurethane clear coat (Standox Standocryl® two-pack HS clear coat with Standox curing agent HS 20-30 in a 2:1 ratio by volume) was applied as an isolation layer to a dry film thickness of approx. 20 μm. After flashing-off for 30 minutes, the UV clear coat II produced as described above was applied to an ultimate dry film thickness of approx. 40 μm. The radiation curing parameters with the UV flash lamp were the same as those in Example 1.

Example 4

Comparative Example

A method similar to that of Example 1 was used, except that, after application of the solvent-based base coat, a conventional two-pack polyurethane clear coat was applied as an isolation layer to a film thickness of approx. 20 μm. After flashing-off for 15 minutes and curing for 30 minutes at 60° C., the UV clear coat II produced as described above was applied to an ultimate dry film thickness of approx. 40 μm. The radiation curing parameters with the UV flash lamp were the same as those in Example 1.

Example 5

Comparative Example

By way of comparison, a conventional commercial vehicle repair coating structure consisting of a solvent-based two-pack polyurethane filler (see Example 1), a solvent-based base coat (see Example 1) and two-pack polyurethane clear coat (Standox Standocryl® two-pack HS clear coat with Standox curing agent HS 20-30 in a 2:1 ratio by volume) was also applied onto a metal sheet coated by cathodic electrodipcoating.

The detailed results from testing of the coatings are shown in the table below.

Presentation of Coating Results:

| Properties | Example 1 | Example 2 | Example 3 | Example 4 | Example 5 |
|---|---|---|---|---|---|
| Resistance [1] to fuel (directly after drying of coating) | 0-1 | 0-1 | 1 | 0-1 | 4-5 |
| Resistance [1] to fuel (after ageing for 5 days at 20° C.) | 0-1 | 0-1 | 1 | 0-1 | 3 |
| Humidity/Heat test [2] [3] | 1/1 | 1/2 | 3 | 1/2 | 1/2 |
| Adhesion [4] (clear coat/base coat) directly after UV curing | 0-1 | 1 | 3 | 1-2 | 1-2 |
| Adhesion [4] (clear coat/base coat) after Humidity/Heat test [2] | 2 | 2-3 | 3 | 3 | 3 |
| Optical properties | OK | Not OK Shift in colour shade | Not OK Shift in colour shade | Not OK Shift in colour shade | OK |

Example 1: radiation cured, multi-layer clear coat structure according to the invention Example 2: radiation cured, single layer clear coat structure (Comparison)

Example 3: two-pack polyurethane clear coat as an isolation layer (30 min flash-off) (Comparison)

Example 4: two-pack polyurethane clear coat as an isolation layer (15 min flash-off+30 min/60° C.) (Comparison)

Example 5: conventional repair coating structure (Comparison)

[1] Resistance according to VDA testing sheet (VDA—Association of the German Automobile Industry)

[2] Humidity/Heat test to DIN 50017

[3] Evaluation of blistering to DIN EN ISO 4628-2

[4] Crosshatching to DIN EN ISO 2409

The results show that the radiation-curable multi-layer clear coat structure according to the invention is superior to the structure without the UV clear coat intermediate layer (Example 2). This is in particular evident from the clear coat/base coat adhesion results and optical properties, the shift in colour shade being expressed as a distinctly visible greying of the silver metallic colour shade. An interlayer of a conventional two-pack clear coat (Examples 3 and 4) instead of the interlayer of a UV clear coat also exhibits these disadvantageous properties, even after curing of the two-pack clear coat interlayer under conventional conditions. The radiation-curable multi-layer clear coat structure according to the invention moreover matches in some respects the good properties of a conventional solvent-based standard repair coating structure (Example 5) and is distinctly superior thereto in further properties, such as fuel resistance, as was to be expected of a UV curable coating structure.

What is claimed is:

1. A process for the production of a multi-layer coating comprising the following steps:

A) applying a base coat layer of a pigmented colour-imparting and/or special effect-imparting base coat composition onto a substrate precoated with at least one coating layer, B) applying a coating layer of a coating composition curable by means of high-energy radiation onto the base coat layer, wherein the coating composition comprises at least one oligomeric and/or polymeric binder curable by means of high-energy radiation and does not contain reactive diluents curable by means of high-energy radiation, said high-energy radiation having a wave length in the range from 180-420 nm, C) completely curing the coating layer applied in step B) by irradiation with said high-energy radiation, D) applying a clear coat layer of a transparent clear coat composition curable by means of said high-energy radiation onto the cured coating layer without any intermediate step, said transparent clear coat composition comprising:

a) at least one oligomeric and/or polymeric binder curable by means of said high-energy radiation, b) at least one low molecular weight reactive diluent curable by means of said high-energy radiation, c) photoinitiators and optionally d) conventional coating additives, organic solvents and/or water and E) curing the clear coat layer applied in step D) by irradiation with said high-energy radiation.

2. The process according to claim 1, wherein the coating composition curable by means of said high-energy radiation applied in step B) comprises a transparent clear coat.

3. The process according to claim 1, wherein the binders a) curable by means of said high-energy radiation comprise (meth)acryloyl-functional polyurethanes, polyacrylates and/or polyesters.

4. The process according to claim 1, wherein the reactive diluents b) curable by means of said high-energy radiation comprise (meth)acryloyl-functional compounds having one, two or more than two (meth)acryloyl functions.

5. The process according to claim 1, wherein the reactive diluents b) curable by means of said high-energy radiation have an average molar mass of <500 g/mol.

6. The process according to claim 1, wherein the clear coat applied in step D) comprises the oligomeric and/or polymeric binders curable by means of said high-energy radiation a) and the reactive diluents curable by means of said high-energy radiation b) in a ratio by weight of said oligomeric and/or polymeric binders a) said reactive diluents b) of 1:0.3 to 1:3.

7. The process according to claim 6, wherein the ratio by weight of said oligomeric and/or polymeric binders a): said reactive diluents b) is of 1:0.5 to 1:3.

8. The process according to claim 6, wherein the ratio by weight of said oligomeric and/or polymeric binders a): said reactive diluents b) is of 1:1 to 1:2.

9. The process according to claim 1, wherein at least one of the coating compositions curable by means of said high-energy radiation applied in step B) and step D) contains further chemically crosslinking functional groups, wherein the further chemically crosslinking functional groups may be present in the binders curable by means of said high-energy radiation and/or in separate binders.

10. The process according to claim 1, wherein the coating composition curable by means of said high-energy radiation applied in step B) contains up to 30 wt. %, of at least one physically drying binder, relative to the total quantity of the oligomeric and/or polymeric binder curable by means of said high energy radiation.

11. The process according to claim 10, wherein the physically drying binder is based on cellulose esters.

12. The process according to claim 1, wherein irradiation with said high-energy radiation in step C) and/or E) proceeds discontinuously by means of a UV flash lamp.

13. The process of claim 1 wherein said process is a process for repairing a vehicle coating.

14. A process for the production of a multi-layer coating comprising the following steps:

A) applying a base coat layer of a pigmented colour-imparting and/or special effect-imparting base coat composition onto a substrate precoated with at least one coating layer, B) applying a coating layer of a coating composition curable by means of high-energy radiation onto the base coat layer, wherein the coating composition comprises at least one oligomeric and/or polymeric binder curable by means of high-energy radiation and does not contain reactive diluents curable by means of high-energy radiation, said high-energy radiation provided by UV flash lamps having power ranging from 500-3000 Ws, C) completely curing the costing layer applied in step B) by irradiation with said high-energy radiation, D) applying a clear coat layer of a transparent clear coat composition curable by means of said high-energy radiation onto the cured coating layer without any intermediate step, said transparent clear coat composition comprising:

a) at least one oligomeric and/or polymeric binder curable by means of said high-energy radiation, b) at least one low molecular weight reactive diluent curable by means of said high-energy radiation, c) photoinitiators and optionally d) conventional coating additives, organic solvents and/or water and E) curing the clear coat layer applied in step D) by irradiation with said high-energy radiation.

* * * * *